US005417320A

United States Patent [19]

Velan et al.

[11] Patent Number: 5,417,320

[45] Date of Patent: May 23, 1995

[54] BALE TIE FORMED WITH MARCELLED PORTIONS AND PACKAGE COMPRISING COMPRESSED BALE AND SUCH TIE

[75] Inventors: George M. Velan, Mount Prospect; Gale W. Huson, Glenview; John R. Beach, Elmhurst, all of Ill.

[73] Assignee: Illinois Tool Works Inc., Glenview, Ill.

[21] Appl. No.: 274,118

[22] Filed: Jul. 12, 1994

Related U.S. Application Data

[63] Continuation of Ser. No. 18,378, Feb. 16, 1993, abandoned.

[51] Int. Cl.[6] ..... B65D 71/00; B65D 63/02

[52] U.S. Cl. ..... 206/83.5; 24/20 EE; 24/27

[58] Field of Search ..... 206/83.5; 24/20 R, 20 EE, 24/27

[56] References Cited

U.S. PATENT DOCUMENTS

| | | | |
|---|---|---|---|
| 758,820 | 5/1904 | Chaplin . | |
| 1,235,353 | 7/1917 | MacMurray . | |
| 2,085,082 | 6/1937 | Delany . | |
| 2,183,169 | 12/1939 | Prentice . | |
| 2,356,936 | 8/1944 | Krause . | |
| 2,575,899 | 11/1951 | Vining et al. . | |
| 2,599,427 | 6/1952 | Bellingher . | |
| 2,914,643 | 11/1959 | Fields et al. . | |
| 2,915,003 | 12/1959 | Crosby et al. . | |
| 2,915,004 | 12/1959 | Leslie . | |
| 3,088,397 | 5/1963 | Martin et al. . | |
| 3,235,071 | 2/1966 | Simich et al. | 206/83.5 |
| 3,921,799 | 11/1975 | Meier . | |
| 3,934,918 | 1/1976 | Kress et al. | 24/20 EE |
| 3,944,450 | 4/1976 | Bailey . | |
| 4,070,733 | 1/1978 | Simich . | |
| 4,156,385 | 5/1979 | Lems et al. . | |
| 4,226,007 | 10/1980 | Duenser . | |
| 4,228,565 | 10/1980 | Lems et al. . | |
| 4,466,535 | 8/1984 | Huson . | |
| 4,501,356 | 2/1985 | Urban et al. . | |

FOREIGN PATENT DOCUMENTS 26133 of 1898 United Kingdom .

*Primary Examiner*—Jacob K. Ackun
*Attorney, Agent, or Firm*—Schwartz & Weinrieb

[57] ABSTRACT

For tying a compressed bale tending to expand primarily along a major axis, a bale tie made preferably from steel wire or alternatively from steel strap is bent to form two marcelled portions, which are characterized by sinusoidal undulations, which are oriented so as to be generally parallel to the major axis, and along which the tie can straighten to absorb tensile forces. A joint is formed at the opposite ends of the tie. Where bent to form the marcelled portions, the tie has an ultimate strength less than the ultimate strength of an undeformed portion of the tie but more than the ultimate strength of the joint. An apparatus for forming a wire with a marcelled portion comprises upper rolls and lower rolls, which are rotatably mounted and respectively on an upper block and a lower block. The upper block is pivotably mounted upon to the lower block.

14 Claims, 5 Drawing Sheets

100
102
104
106
108
110
112
118
124
130
140
150
152
160
162
164
166
30
32
45°
60°
10
12

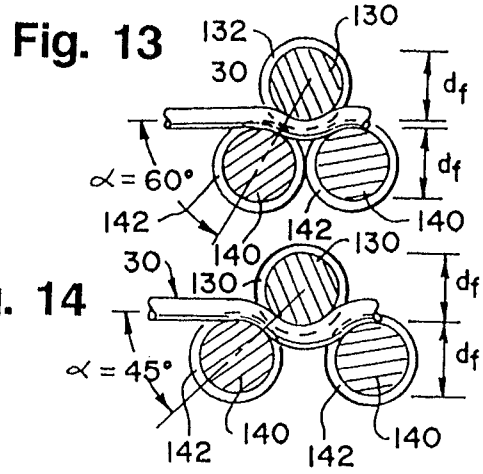
Fig. 13
Fig. 14
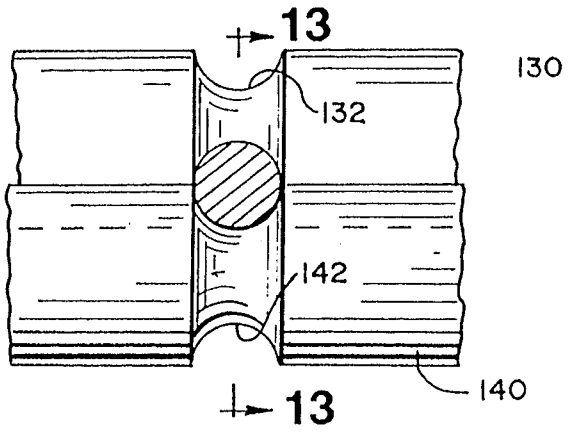
Fig. 12
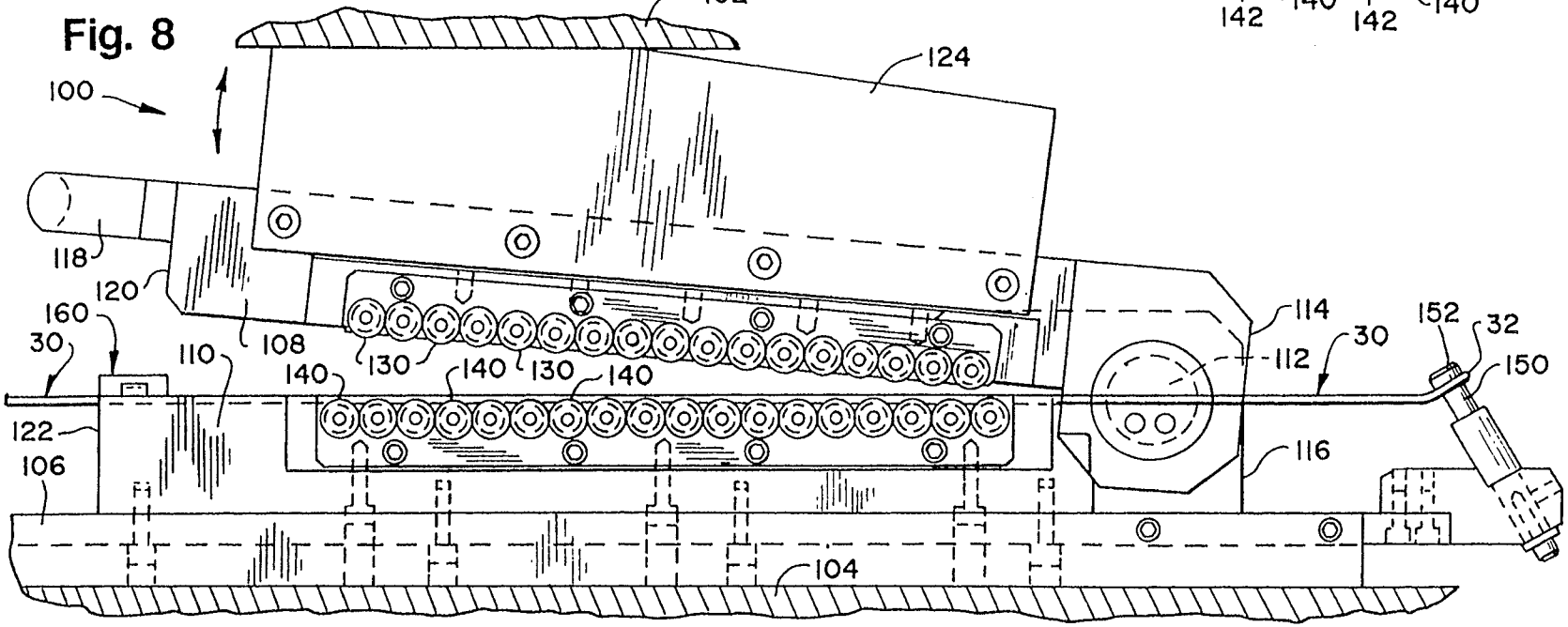
Fig. 8

BALE TIE FORMED WITH MARCELLED PORTIONS AND PACKAGE COMPRISING COMPRESSED BALE AND SUCH TIE

This application is a continuation of application Ser. No. 08/018,378, filed Feb. 6, 1993, and now abandoned.

TECHNICAL FIELD OF THE INVENTION

This invention pertains to a bale tie for tying a compressed bale, such as a cotton bale, which tends to expand along a major axis. According to this invention, the bale tie is formed so as to have at least one marcelled portion, along which the bale tie can straighten to absorb tensile forces. This invention pertains also to a package comprising such a bale and such a tie. This invention pertains further to an apparatus useful in forming a wire with such a marcelled portion.

BACKGROUND OF THE INVENTION

Specifications for cotton bale packaging materials are approved from time to time by the Joint Cotton Industry Bale Packaging Committee (JCIBPC). According to the 1992 JCIBPC specifications, approved materials for bale ties include cold rolled, high tensile steel strapping, which may employ a fixed-seal connection, a controlled-slip connection, or a keylock type connection, and steel wire conforming to ASTM A 510-82 and employing an interlocking connection or a twistlock connection.

Steel strapping ties with controlled-slip connections are exemplified in Huson U.S. Pat. No. 4,466,535 and in Urban et al. U.S. Pat. No. 4,501,356. Steel strapping ties with keylock type connections are exemplified in Lems et al. U.S. Pat. No. 4,156,385, Duenser U.S. Pat. No. 4,226,007, and Lems et al. U.S. Pat. No. 4,228,565. Steel wire ties with interlocking connections are exemplified in Bailey U.S. Pat. No. 3,949,450 and in Simich U.S. Pat. No. 4,070,733.

Typically, a cotton bale is compressed along a major axis and tends to expand primarily along the major axis, which is vertical in a context of the aforenoted specifications. Such a bale may impart tensile forces as high as 1,800 pounds on the bale ties, along the major axis. However, such a bale tends to expand minimally along its other axes, which are orthogonal to each other and to the major axis.

The 1992 JCIBPC specifications for wire ties for use on so-called Gin Standard and Gin Universal Density Bales provide that ties shall not be smaller than 9 gauge, that the breaking strength of the wire must not be less than 3,400 pounds with a joint strength of not less than 2,100 pounds with the joint placed on the tops of the bales, and that, if the joints are placed on the sides of the bales, the breaking strength of the wire must be not less than 3,200 pounds with a joint strength of not less than 3,040 pounds. These specifications apply whether the joint is provided by an interlocking connection or by a twistlock connection. Steel wire of 9 gauge has a nominal diameter of 0.1483 inch.

As explained below, this invention enables wire bale ties of a smaller gauge to be effectively used by reducing tensile forces imparted by such a bale on the joints of such bale ties.

As a matter of related interest, Martin et al. U.S. Pat. No. 3,088,397 discloses a machine for providing steel strapping with transverse corrugations as the strapping is being fed through a strapping machine, whereby each strap applied by the machine is corrugated or marcelled over its entire length. As disclosed therein, each strap thus has resiliency to permit swelling of a bundle bound by the strap, such as a paper roll or a bag.

SUMMARY OF THE INVENTION

This invention provides a bale tie having an improved structure for tying a compressed bale, such as cotton bale, which conforms generally to a rectangular solid, which defines mutually orthogonal axes including a major axis, and which tends to expand primarily along the major axis. According to this invention, the bale tie is formed so as to have at least one marcelled portion, along which the bale tie can straighten so as to absorb some of the tensile force imparted to the bale tie by such a bale having the bale tie wrapped therearound.

The bale tie has sufficient length and sufficient flexibility to permit the bale tie to be wrapped around such a bale. The opposite ends of the bale tie are joinable to each other so as to form a joint when the bale tie is wrapped around such a bale. The wire is formed so as to have at least one marcelled portion, which is located between two generally straight portions of the bale tie, which is characterized by a series of sinusoidal undulations, and along which the bale tie can straighten so as to absorb tensile forces imparted to the bale tie by such a bale having the bale tie wrapped therearound. The marcelled portion constitutes means for preventing maximum tensile forces imparted to the bale tie by such a bale having the bale tie wrapped therearound from being applied to a joint formed at the opposite ends.

Preferably, the bale tie is formed so as to have exactly two marcelled portions, which together account for substantially less than one half of the overall length of the wire. Preferably, moreover, the marcelled portions are spaced from each other and are positionable so as to be generally parallel to the major axis when the bale tie is wrapped around such a bale.

Preferably, the bale tie is made solely from a precut, steel wire, which is formed so as to have the marcelled portions and to form a joining formation at each of the opposite ends. The joining formations are engageable with each other so as to form the joint. Alternatively, the bale tie comprises a precut, steel strap formed so as to have the marcelled portions whereupon a fixed-seal connection, a controlled-slip connection, or a keylock type connection may then be used to form the joint.

Generally, as in bale ties known heretofore, such a joint has an ultimate strength less than the ultimate strength of an undeformed portion of the bale tie. This invention contemplates that, where the bale tie is formed so as to have at least one marcelled portion, the bale tie has an ultimate strength less than the ultimate strength of an undeformed portion of the bale tie but more than the ultimate strength of such a joint.

In one contemplated example wherein the bale tie is made solely from a precut, steel wire, such a joint has an ultimate strength equal approximately to 65% of the ultimate strength of an undeformed portion of the wire, and the ultimate strength of the wire where formed so as to have at least one marcelled portion is from approximately 85% to approximately 90% of the ultimate strength of an undeformed portion of the wire.

Herein, "breaking strength" and "ultimate strength" are used interchangeably to refer to tensile strength, which (in tensile testing) is the ratio of maximum load to original cross-sectional area; see J. R. Davis, Ed., *ASM*

*Materials Engineering Dictionary*, ASM International (1992).

This invention also provides an improved package comprising a compressed bale, as described above, and a bale tie having sufficient length and sufficient flexibility to permit the bale tie to be wrapped around the bale and being wrapped therearound. A joint is formed at the opposite ends of the bale tie. According to this invention, the bale tie is formed so as to have two marcelled portions, each of which is located between two generally straight portions of the bale tie. Each of the marcelled portions is characterized by a series of sinusoidal undulations. The marcelled portions together utilize less than one half of the overall length of the bale tie. The bale tie can straighten along the marcelled portions so as to absorb tensile forces imparted to the bale tie by the bale as the bale tends to expand primarily along the major axis.

This invention permits a tensile load imparted to a wire having a marcelled portion, which is characterized by a series of sinusoidal undulations, to be effectively measured. After a first tensile load is imparted to the wire so that the marcelled portion tends to yield so as to straighten, and after the wire is released from the first tensile load, a second tensile load known to exceed the first tensile load is imparted to the wire while elongation of the wire is measured.

This invention further provides an apparatus for forming a wire so as to provide the wire with a marcelled portion characterized by a series of sinusoidal undulations. The apparatus comprises two elongate mounting blocks, namely an upper mounting block and a lower mounting block, a set of upper forming rolls, and a set of lower forming rolls.

The upper mounting block is mounted to the lower forming block so as to permit relative movement of the mounting blocks between a closed condition and an opened condition. The upper mounting block is close to the lower mounting block in the closed condition and displaced from the lower mounting block in the opened condition.

Each upper forming roll is mounted to the upper forming block so as to be freely rotatable about an upper axis extending transversely. The upper axes, about which the upper forming rolls are rotatable, are coplanar and are spaced uniformly from one another. Each upper forming roll has a circumferential groove adapted to receive a wire. Preferably, the upper mounting block is pivotably mounted to the lower mounting block so as to be pivotally movable about a transverse axis, which is spaced from the set of upper forming rolls.

Each lower forming roll is mounted to the lower forming block so as to be freely rotatable about a lower axis extending transversely. The lower axes, about which the lower forming rolls are rotatable, are coplanar and are spaced uniformly from one another. Each lower forming roll has a circumferential groove adapted to receive a wire.

The upper and lower forming rolls are arranged so that their circumferential grooves define a sinusoidal track for a wire when the mounting blocks are in a closed condition. The upper and lower forming rolls constitute means for forming a wire received by their circumferential grooves so as to provide the formed wire with a series of sinusoidal undulations conforming generally to the sinusoidal track upon relative movement of the mounting blocks to the closed condition.

BRIEF DESCRIPTION OF THE DRAWINGS

These and other objects, features, and advantages of this invention will become evident from the following description of embodiments of this invention with reference to the accompanying drawings in which like reference characters designate like or corresponding parts throughout the several views, and wherein:

As shown in FIG. 4, linking formations at the opposite ends are engaged with each other to form a joint.

FIGS. 8 and 9 are elevational views of an apparatus provided by this invention and comprising one contemplated arrangement of upper rollers and lower rollers, as used to provide a wire tie with a marcelled portion. FIG. 8 shows the apparatus in an opened condition, in a press. FIG. 9 shows the apparatus in a closed condition, in the press.

FIG. 10 is a sectional view taken along line 10—10 of FIG. 9, in the direction indicated by the arrows.

FIG. 11 is a fragmentary, elevational detail of portions of an apparatus similar to the apparatus of FIGS. 8 and 9 but comprising a different arrangement of such upper and lower rollers. FIG. 11 shows the apparatus in a closed condition.

FIG. 12, on a greatly enlarged scale, is a fragmentary, cross-sectional detail taken along line 12—12 of FIG. 9, in a the direction indicated by the arrows.

FIGS. 13 and 14, on a smaller scale, are similar, cross-sectional details showing two different arrangements of such upper and lower rollers coacting with the wire tie. The arrangement of FIG. 14 corresponds to the arrangement of FIGS. 8 and 9.

DETAILED DESCRIPTION OF ILLUSTRATED EMBODIMENTS

Figure 1:
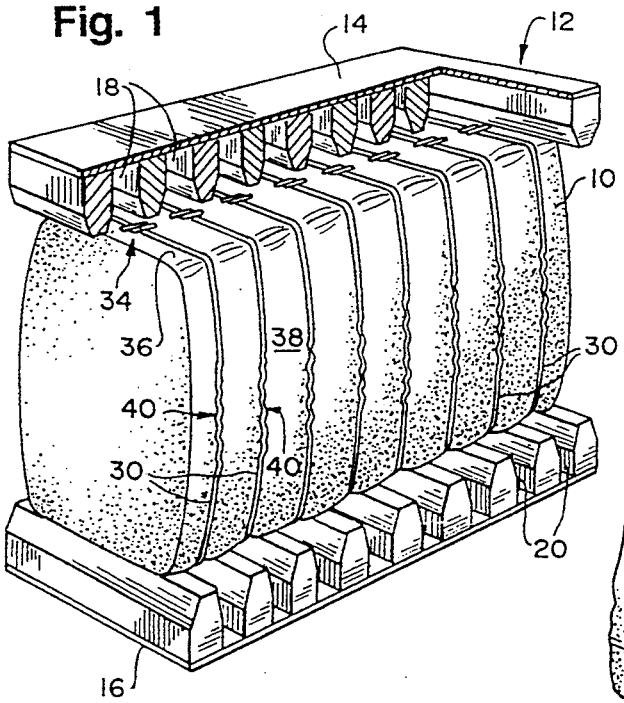
FIG. 1 is a perspective view of a compressed bale, such as a cotton bale, as tied with a plurality of similar bale ties made from precut, steel wires with marcelled portions according to this invention. Relatively movable platens of a conventional baling press are shown fragmentarily.
Figure 2:
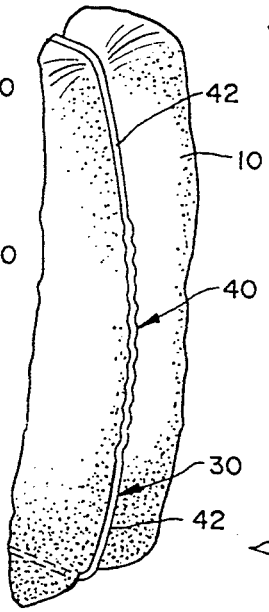
FIG. 2 is an enlarged, fragmentary, perspective detail taken from FIG. 1 and showing a representative one of the wire ties used to tie the bale.

As shown in FIGS. 1, 2, 3, and 4, a cotton bale 10 is compressed vertically in a conventional baling press 12, which has an upper, fixed platen 14 and a lower, movable platen 16. Because the bale 10 is compressed vertically in the press 12, the bale 10 tends to expand primarily along a vertical axis, which is regarded as the major axis of the bale 10 in the context of this invention. However, the bale 10 tends to expand minimally along its transverse and longitudinal axes. The upper platen 14 has a series of regularly spaced channels 18 and the lower platen 16 has a series of similarly spaced channels 20. Eight channels 18 and eight channels 20 are shown. These channels 18, 20, permit eight bale ties 30 to be manually wrapped around the bale 10 while the bale 10 remains compressed in the press 12.

Each bale tie 30 has sufficient length (for example approximately 89 inches) and sufficient flexibility to permit such bale tie 30 to be manually wrapped around the bale 10 while the bale 10 remains compressed in the press 12.

Figure 3:
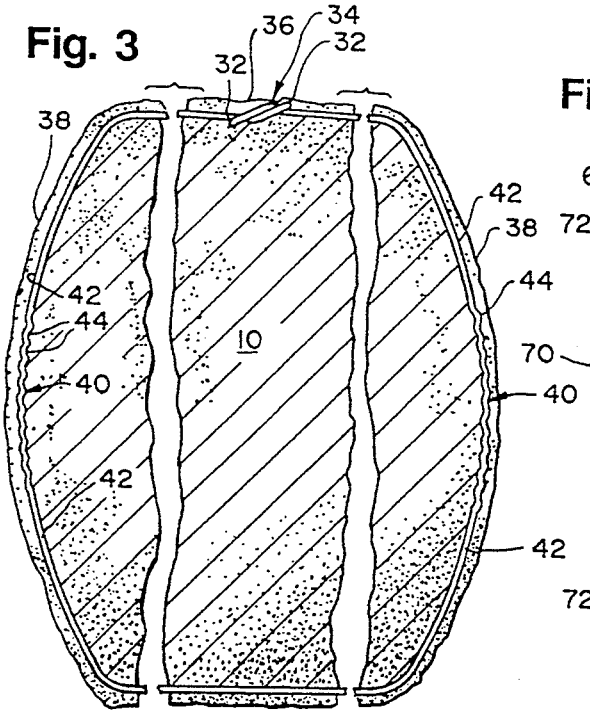
FIG. 3 is an enlarged, fragmentary, cross-sectional view of the bale of FIG. 1.
Figure 4:
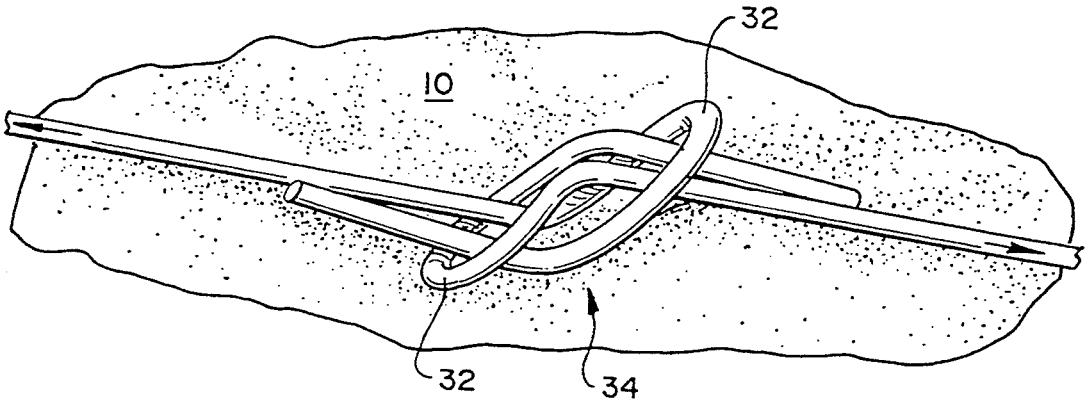
FIG. 4 is a further enlarged, fragmentary detail view of the opposite ends of a representative one of the wire ties, as used to tie the bale of FIGS. 1, 2, and 3.

Each bale tie 30 is made solely from a precut, steel wire. As shown in FIGS. 3 and 4, each bale tie 30 is bent at each of its opposite ends so as to form a locking formation 32 of a loop type used widely on wire bale ties, as exemplified in Simich U.S. Pat. No. 4,070,733, the disclosure of which is incorporated herein by reference. The locking formations 32 of each bale tie 30 are engageable with each other, in a well known manner, so as to form a joint 34 of a known type when such bale tie 30 is wrapped around the bale 10 while the bale 10 remains compressed in the press 12. Generally, as in wire bale ties known heretofore, such a joint 34 has an ultimate strength less than the ultimate strength of an undeformed portion of the steel wire used for the bale ties 30. This invention contemplates that locking formations (not shown) of a type other than the loop type may be alternatively used.

Preferably, as shown, the bale ties 30 are wrapped around the bale 10 so that the joints 34 are disposed at the top 36 of the bale 10 when the bale 10 is released from the press 12. However, the bale ties 30 may be initially wrapped around the bale 10 so that the joints 34 are formed at one of the sides 38 of the bale 10, preferably near the bale top 36. The bale ties 30 may be subsequently shifted around the bale 10 so that the joints 34 are disposed at the bale top 36 before the bale 10 is released from the press 12.

In one contemplated example, wherein the steel wire is 10 gauge wire with a nominal diameter of 0.1350 inch, an ultimate strength of approximately 2,850 pounds if undeformed, a maximum elongation of 2%, and a composition conforming to AISI C 1070, such a joint 34 has an ultimate strength equal approximately to 1,850 pounds, which is approximately 65% of the ultimate strength of an undeformed portion of such wire.

Such a bale 10 may impart a tensile force as high as 1,800 pounds on each bale tie 30, along the major axis. However, as explained below, this invention permits a bale tie 30 according to the aforenoted example (see the preceding paragraph) to be effectively used without exposing the joint 34 formed at its opposite ends to tensile forces approaching the ultimate strength of such joint 34.

According to this invention, each bale tie 30 is formed so as to have exactly two marcelled portions 40, each of which is located between two generally straight portions 42 of such bale tie 30. Each marcelled portion 40 is characterized by a series of similar, sinusoidal undulations 44. The marcelled portions 40 of each bale tie 30 together account for substantially less than one half of the overall length of such bale tie 30. In one contemplated example, each bale tie 30 has an overall length of approximately 89 inches, and each marcelled portion 40 has an apparent length of approximately 10 inches. The marcelled portions 40 reduce the overall length of each bale tie 30 only by 0.25 inch to about 0.375 inch. When each bale tie 30 is wrapped around the bale 10, the generally straight portions 42 may be slightly bowed, as shown.

As spaced from each other along each bale tie 30, the marcelled portions 40 are positioned so as to be generally parallel to the major axis when such bale tie 30 is wrapped around the bale 10 so that the joint 34 of such bale tie 30 is disposed at the top 36 of the bale 10. Thus, when the bale 10 is released from the press 12, each bale tie 30 can straighten along the marcelled portions 40 so as to absorb some of the tensile forces imparted to such bale tie 30 by the bale 10 as the bale 10 tends to expand primarily along the major axis.

In the aforenoted example, wherein the steel wire is 10 gauge wire with a nominal diameter of 0.1350 inch, an ultimate strength of approximately 2,850 pounds if undeformed, a maximum elongation of 2% and a composition conforming to AISI C 1060, the steel wire where formed so as to have the marcelled portions 40 has an ultimate strength from approximately 85% to approximately 95% of the ultimate strength of an undeformed portion of the steel wire.

When tensioned, a straight portion of a steel wire acts as a very stiff spring, until the wire begins to stretch near its yield point. Thus, if tensioned and released below its yield point, the straight portion tends to spring back to its original length. A marcelled portion of a steel wire, however, begins to yield so as to straighten almost immediately when tensioned. Thus, if tensioned and released, the marcelled portion tends to spring back partially but not to its original length.

Figure 15:
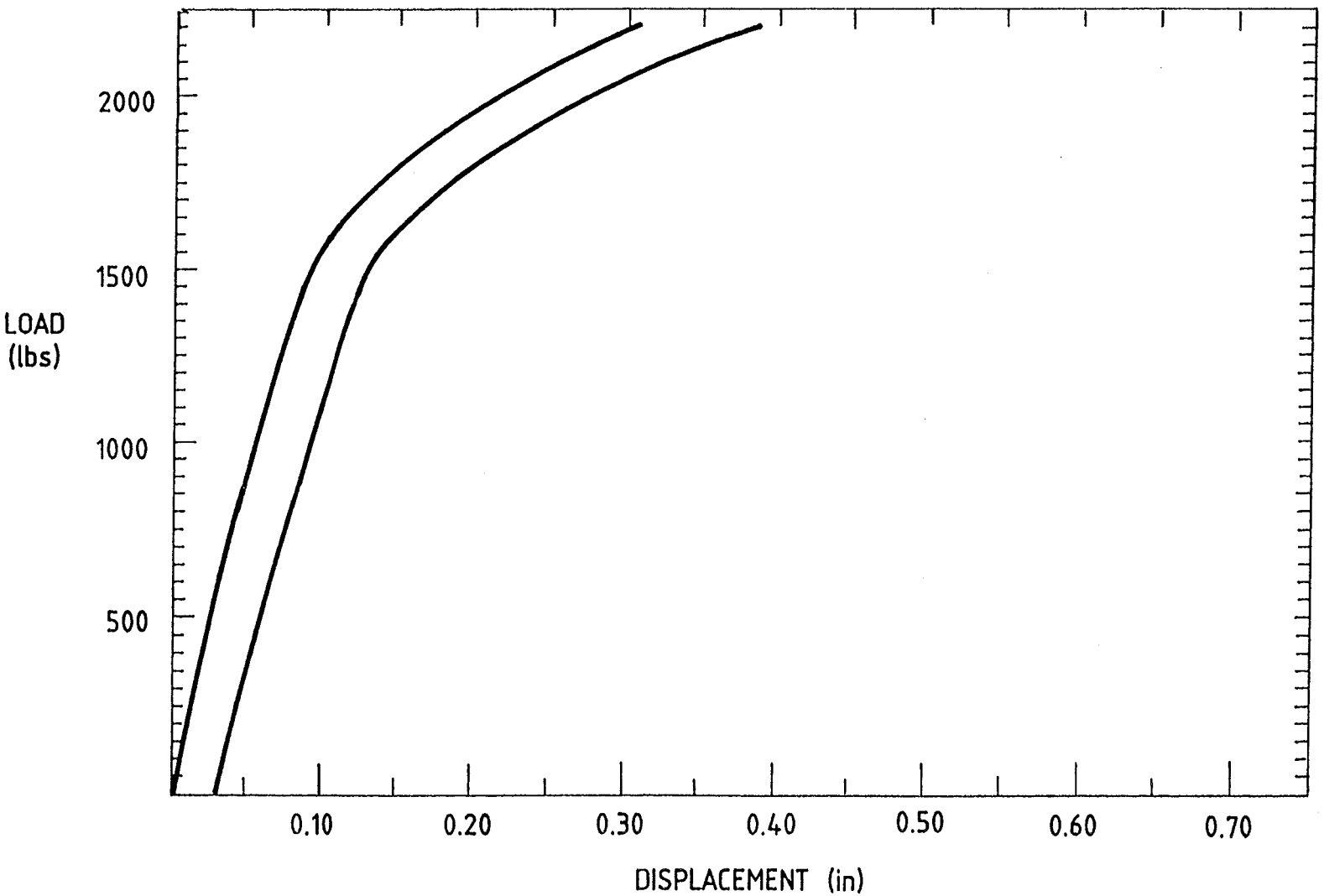
FIG. 15 is a chart showing tensile characteristics of two wire ties with marcelled portions that have been loaded to 1500 pounds tension, released, and then reloaded to 2200 pounds tension.

Once tensioned and released from the tensile load, the marcelled portion exhibits a memory for the maximum tension applied to such portion. Thus, the maximum tension applied by a bale to a wire bale tie having a marcelled portion is measurable to an accuracy of approximately ±5% on a computerized, tensile testing machine after the bale tie has been removed from the bale. FIG. 15 is a chart showing elongation ("Displacement") of two specimens, each being a marcelled portion of a steel wire, each having been loaded with a tensile force of approximately 1,500 pounds and each being reloaded (in such a testing machine) with a tensile force ("Load") of approximately 2,200 pounds.

Figure 5:
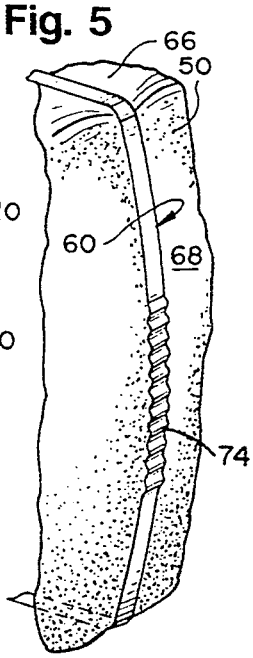
FIG. 5 is a fragmentary, perspective detail view similar to FIG. 2 but showing a similar bale tied with a bale tie comprising a precut, steel strap with marcelled portions according to this invention, along with a seal applied to overlapping ends of the strap. The strap tie is representative of a plurality of similar ties used to tie the similar bale.
Figure 6:
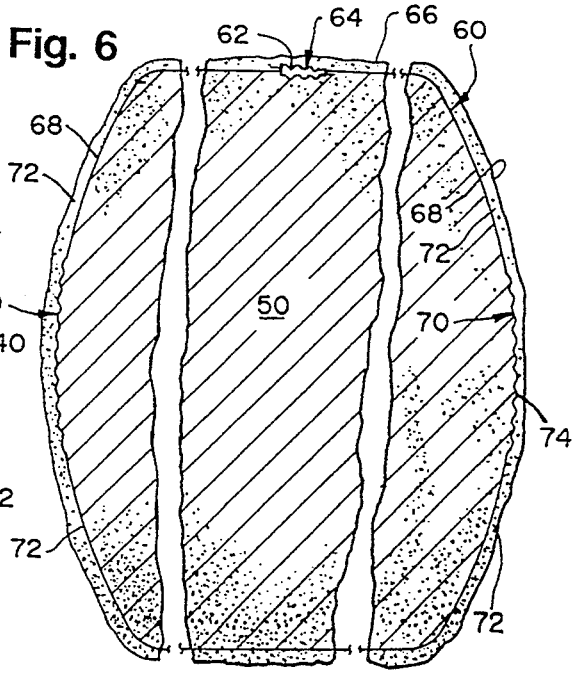
FIG. 6 is a fragmentary, cross-sectional view of the bale of FIG. 5.
Figure 7:
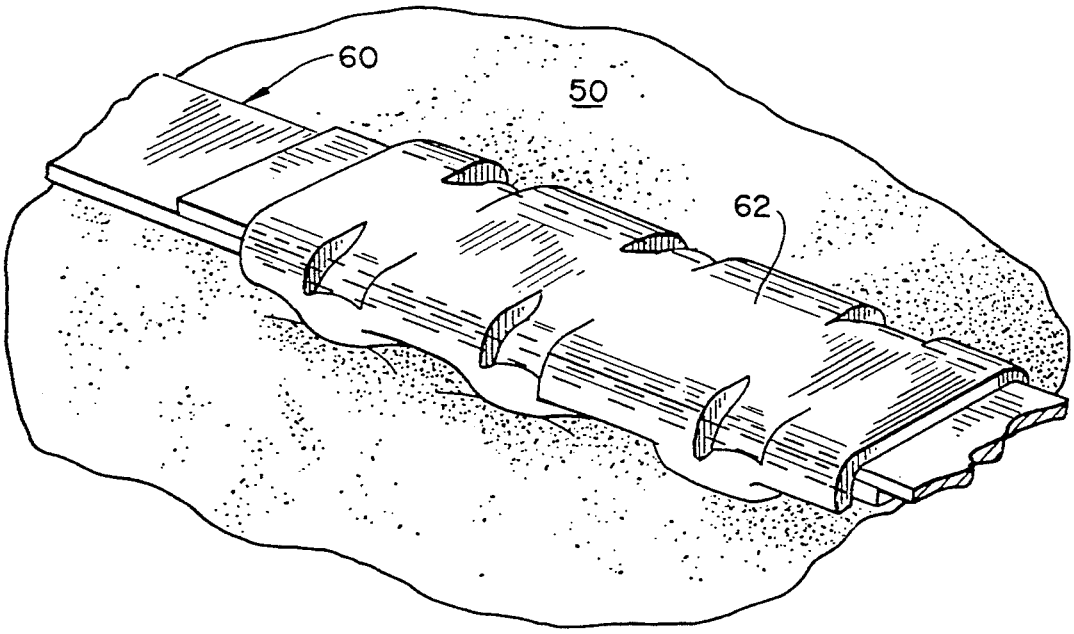
FIG. 7 is an enlarged, fragmentary detail view of the opposite ends of the strap tie, as used to tie the bale of FIGS. 5 and 6.

As shown in FIGS. 5, 6, and 7, a cotton bale 50 similar to the cotton bale 10 and compressed similarly in a conventional baling press (not shown) similar to the press 12 is tied by bale ties 60 (one shown) of a different construction, which also embodies this invention. Because the bale 50 is compressed vertically, the bale tends to expand primarily along a vertical axis, which is the major axis of the bale 50 in the context of this invention.

Each bale tie 60 comprises a precut, steel strap having two overlapping ends when wrapped around the bale 50, along with a steel seal 62 applied to the overlapping ends of the strap 60 so as to form a joint 64. The joint 64 has an ultimate strength less than the ultimate strength of an undeformed portion of the steel strap 60. Except as illustrated and described herein, each bale tie 60 is similar to steel strapping ties available commercially from ITW Signode (a unit of Illinois Tool Works Inc.) of Glenview, Ill.

This invention contemplates that a controlled-slip connection, as exemplified in Huson U.S. Pat. No. 4,466,535 or Urban et al. U.S. Pat. No. 4,501,356, or a keylock type connection, as exemplified in Lems et al. U.S. Pat. No. 4,156,385, Duenser U.S. Pat. No. 4,226,007, or Lems et al. U.S. Pat. No. 4,228,565, may be alternatively employed to form a joint at the overlapping ends of such a strap.

Preferably, as shown, each bale tie 60 is wrapped around the bale 50 so that the joint 64 of such bale tie 60 is disposed at the top 66 of the bale 50 when the bale 50 is released from the press noted above. However, each bale tie 60 may be initially wrapped around the bale 50 so that the joint 64 of such bale tie 60 is formed at one of the sides 68 of the bale 50, preferably near the bale top 66. Such bale tie 60 may be subsequently shifted so that the joint 64 of such bale tie 60 is disposed at the bale top 66 before the bale 50 is released from the press noted above.

According to this invention, each bale tie 60 is formed so as to have exactly two marcelled portions 70, each of which is located between two generally straight portions 72 of such bale tie 60. Each marcelled portion 70 is characterized by a series of similar, sinusoidal undulations 74. The marcelled portions 70 of each bale tie 60 together account for less than one half of the overall length of such bale tie 60. In one contemplated example, as shown, the marcelled portions 70 of each bale tie 60 together account for approximately one fifth of the overall length of such bale tie 60. When each bale tie 60 is wrapped around the bale 50, the generally straight portions 72 may be slightly bowed, as shown.

As spaced from each other along each bale tie 60, the marcelled portions 70 are positioned so as to be generally parallel to the major axis when such bale tie 60 is wrapped around the bale 50 so that the joint 64 of such bale tie 60 is disposed at the top 66 of the bale 50. Thus, when the bale 50 is released from the press noted above, each bale tie 60 can straighten along the marcelled portions 70 so as to absorb some of the tensile forces imparted to such bale tie 60 by the bale 50 as the bale 50 tends to expand primarily along the major axis.

Figures 9, 10, 11:
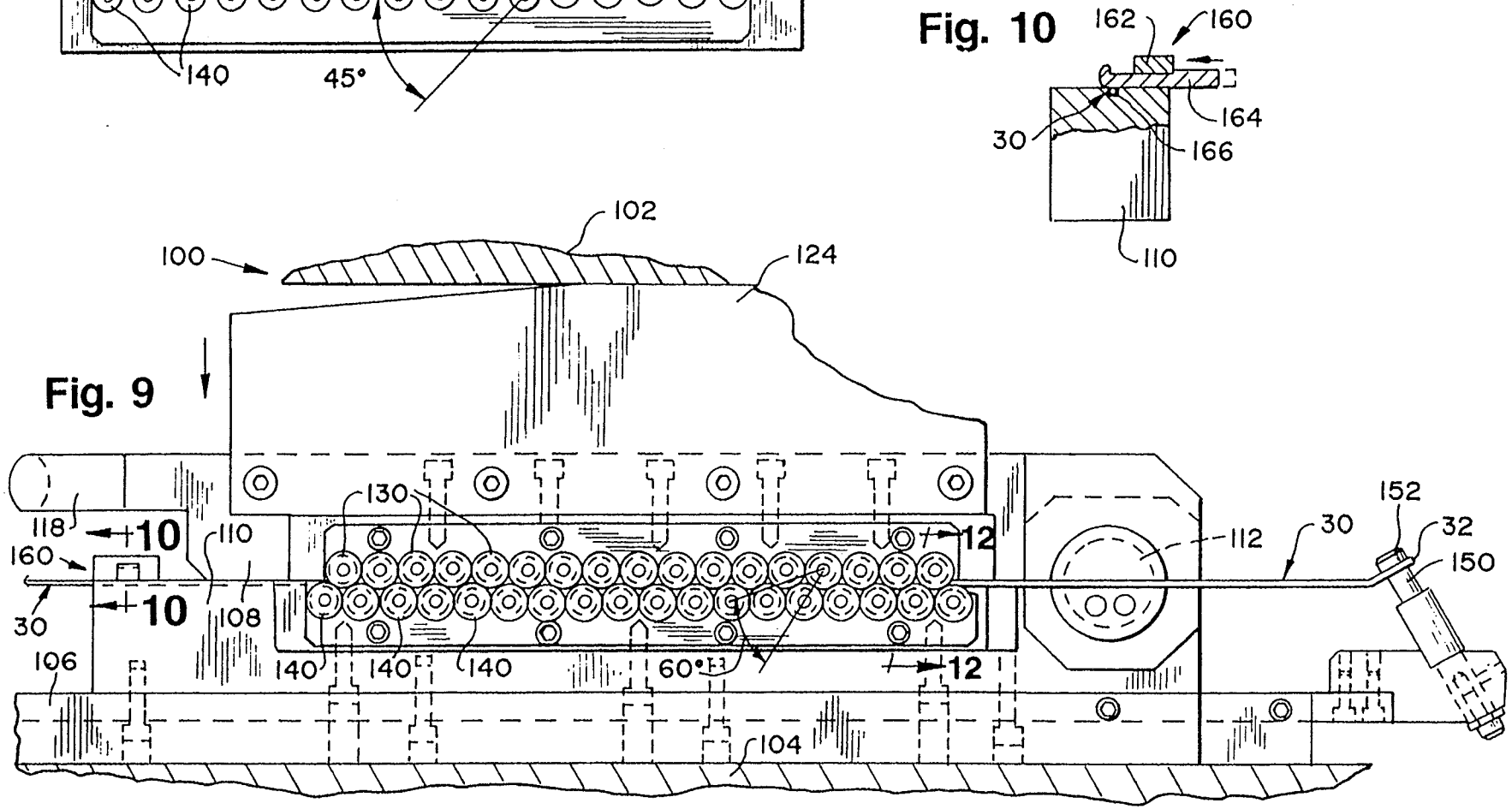

As shown in FIGS. 8 and 9 and other views, an apparatus 100 according to this invention is useful for forming the steel wire of a bale tie 30 with a marcelled portion 40 near the locking formation 32 at each of the opposite ends of such bale tie 30. The apparatus 100 is useful with a conventional press, such as an arbor press, which comprises an upper, movable platen 102 and a lower, fixed platen 104. Except for the platens 102, 104, which are shown fragmentarily, the press is not shown. In such a press, the upper platen 102 is movable upwardly and downwardly.

The apparatus 100 comprises an elongate base 106, which supports two elongate mounting blocks, namely an upper mounting block 108 and a lower mounting block 110. The upper mounting block 108 is mounted upon the lower mounting block 110, by means of a pivot pin 112 defining a transverse axis, about which the upper mounting block 108 is pivotable, so as to permit relative, pivotal movement of the mounting blocks 108, 110, between a closed condition and an opened condition. The pivot pin 112 is operatively mounted near one end 114 of the upper forming block 108 and near one end 116 of the lower mounting block 110. A handle 118 is mounted upon the other end 120 of the upper forming block 108, near the other end 122 of the lower forming block 110.

In FIG. 8, the base 106 and the mounting blocks 108, 110, are shown between the platens 102, 104, in the opened condition, in which the upper mounting block 108 is displaced at an acute angle with respect to the lower mounting block 110. In FIG. 9, the base 106 and the mounting blocks 108, 110, are shown between the platens 102, 104, in the closed condition, in which the upper mounting block 108 is close to the lower mounting block 110 and is parallel thereto.

As shown in FIGS. 8 and 9, the base 106 is adapted to rest on the lower platen 104. A camming structure 124, which is fixed to the upper forming block 108, is adapted to engage the upper platen 102.

A set of seventeen, similar, upper forming rolls 130 is provided. Each upper forming roll 130 is mounted upon the upper forming block 108 so as to be freely rotatable about an upper axis extending transversely. The upper axes, about which the upper forming rolls 130 are rotatable, are coplanar and are spaced uniformly from one another. The upper forming rolls 130 are mounted upon the upper forming block 108 so that the pivot pin 112 is located between the upper forming rolls 130 and the end 114 of the upper forming block 108. Each upper forming roll 130 has a circumferential groove 132, which is adapted to receive the steel wire of a bale tie 30, and which is shaped so as to conform generally to one half-section of a 10 gauge wire. As shown in Figure 12, the circumferential grooves 132 are semi-circular in cross-section.

A set of eighteen, similar, lower forming rolls 140 is provided. Each lower forming roll 140 is mounted upon lower mounting block 108 so as to be freely rotatable about a lower axis extending transversely. The lower axes, about which the lower forming rolls 140 are rotatable, are coplanar and are spaced uniformly from one another. The lower forming rolls 140 are mounted upon the lower forming block 110 so that the pivot pin 112 is located between the lower forming rolls 140 and the end 114 of the lower forming block 110. Each lower forming roll 140 has a circumferential groove 142, which is adapted to receive the steel wire of a bale tie 30, and which is shaped so as to conform generally to one half-section of a 10 gauge wire. As shown in Figure 12, the circumferential grooves 142 are semi-circular in cross-section.

A locating pin 150 having an enlarged head 152 is fixedly mounted upon the lower forming block 110, near the end 114. The locating pin 150 is arranged to permit a locking formation 32 at one of the opposite ends of a bale tie 30 to be manually hooked over the enlarged head 152, which locates and restrains such one end of the bale tie 30 in the apparatus 100.

A latching device 160 is mounted upon the lower forming block 110, near the end 122. The latching device 160 comprises a guide 162, which is fixedly mounted upon the lower forming block 110, and a latch 164, which is movably mounted upon the guide 162. The latching device 160 is adapted to restrain, within a groove 166 of the lower forming block 110, a portion of the steel wire of a bale tie 30 having a locking formation 32 hooked over the enlarged head 152 of the locating pin 150.

The forming rolls 130, 140, are arranged so that the circumferential grooves 132, 142, define a sinusoidal track for the steel wire of a bale tie 30 when the mounting blocks 108, 110, are in the closed condition. The forming rolls 130, 140, constitute means forming the steel wire received by the circumferential grooves 132, 142, so as to provide the formed wire with a series of sinusoidal undulations conforming generally to the sinusoidal track upon relative movement of the mounting blocks 108, 110, to the closed condition.

Initially, as suggested in FIG. 8, the upper platen 102 is moved upwardly, and the upper mounting block 108 and the upper forming rolls 130 are pivoted upwardly to the opened condition of the forming blocks 108, 110, by means of the handle 118. Next, a bale tie 30 for forming with a marcelled portion 40 is positioned so that a linking formation 32 at one of the opposite ends of the bale tie 30 is hooked over the enlarged head 152 of the locating pin 150, so that the steel wire of the bale tie 30 is received by the circumferential grooves 142 of the lower forming rolls 140, and so that a portion of the steel wire is restrained by the latching device 160. Thereupon, the upper platen 102 is lowered so as to pivot the upper mounting block 108 and the upper forming rolls 130 to the closed condition of the forming blocks 108, 110, whereby the circumferential grooves 132 of the upper forming rolls 130 receive the steel wire. Thus, the forming rolls 130, 140 form the steel wire so as to provide the formed wire with a series of sinusoidal undulations defining a marcelled portion 40 of the bale tie 30.

The pitch and amplitude of the series of sinusoidal undulations depends upon the forming angle $\alpha$ and upon the forming diameter $d_f$. As shown in FIGS. 13 and 14, the forming angle is defined by the central axis of an undeformed portion of a steel wire received by the circumferential grooves 142 of the lower forming rolls 140 and by a line passing through the lower axis of a given one of the lower forming rolls 140 and through the upper axis of the next one of the upper forming rolls 130 when the mounting blocks 108, 110, are in the closed condition. As shown therein, the forming diameter df is the diameter of each of the forming rolls 130, 140, where the circumferential grooves 132, 142, are deepest.

Preferably, the forming angle $\alpha$ is selected from a range from approximately 45° to approximately 60°. Preferably, the forming diameter is selected from a range from approximately 0.375 inch to approximately 0.5 inch.

Various modifications may be made in the preferred embodiments described above without departing from the scope and spirit of this invention. It is therefore understood that within the scope of the appended claims, the present invention may be practiced otherwise than as specifically described herein.

We claim:

1. A bale tie, for tying a compressed bale which has a configuration which is substantially that of a rectangular solid defining mutually orthogonal longitudinal, transverse, and compression axes, wherein said bale is initially compressed along said compression axis and thereafter tends to expand primarily along said compression axis, comprising:

a tie element having two opposite ends and a sufficient length and flexibility so as to permit said tie element to be wrapped around a bale, said opposite ends of said tie element being joinable to each other so as to form a joint when said tie element is wrapped around said bale; and two marcelled means, located upon opposite sides of said bale between substantially straight portions of said tie element and respectively comprising a series of sinusoidal undulations, for permitting said tie element to expand along both of said opposite sides of said bale in a direction parallel to said compression axis as a result of said undulations of said marcelled means straightening out in response to said tendency of said bale to normally expand primarily along said compression axis, after being initially compressed along said compression axis and wrapped by said tie element, so as to absorb tensile forces, imparted to said tie element by said compressed bale tending to expand and having said tie element wrapped therearound, and thereby prevent maximum tensile forces from being applied to opposite ends of said joint formed at said opposite ends of said tie element.

2. The bale tie of claim 1, wherein:

said two marcelled portions comprising said tie element together utilize less than one half of the overall length of said tie element.

3. The bale tie of claim 2 wherein said tie element is made solely from a steel wire, which is formed so as to have the marcelled portions and to form a joining formation at each of the opposite ends, the joining formations being engageable with each other so as to form the joint.

4. The bale tie of claim 3 wherein the joint has an ultimate strength equal approximately to 65% of the ultimate strength of an undeformed portion of the wire and wherein the ultimate strength of the wire where bent to form said two marcelled portions is approximately 85% to approximately 95% of the ultimate strength of an undeformed portion of the wire.

5. The bale tie of claim 2, wherein said tie element comprises a steel strap bent to form the marcelled portions.

6. A package, comprising:

a compressed bale which has a configuration which is substantially that of a rectangular solid defining mutually orthogonal longitudinal, transverse, and compression axes, wherein said bale is initially compressed along said compression axis and thereafter tends to expand primarily along said compression axis; and a bale tie having two opposite ends and being precut to a sufficient length and having sufficient flexibility so as to permit said bale tie to be wrapped around said bale, said opposite ends of said bale tie being joined so as to form a joint when said bale tie is wrapped around said bale;

said bale tie including two marcelled means, defined along portions thereof which are located upon opposite sides of said bale between substantially straight portions of said bale tie and respectively comprising a series of sinusoidal undulations disposed substantially parallel to said compression axis, for permitting said bale tie to expand along both of said opposite sides of said bale in a direction parallel to said compression axis as a result of said undulations of said marcelled means straightening out in response to said tendency of said bale to normally expand primarily along said compression axis, after being initially compressed along said compression axis and wrapped by said bale tie, so as to absorb tensile forces, imparted to said bale tie by said compressed bale as said compressed bale, having said bale tie wrapped therearound, tends to expand primarily along said compression axis, and thereby prevent maximum tensile forces from being applied to opposite ends of said joint formed at said opposite ends of said bale tie.

7. The package of claim 6 wherein the bale tie is made solely from a steel wire bent to form a joining formation at each of the opposite ends of the bale tie, the joining formations being engaged with each other so as to form the joint.

8. The package of claim 6, wherein:

said bale tie comprises a steel strap and said two marcelled portions together utilize less than one half of the overall length of said bale tie.

9. The package as set forth in claim 6, wherein:

said joint has an ultimate strength which is less than the ultimate strength of an undeformed portion of said bale tie; and said bale tie, where formed with said at least one marcelled portion, has an ultimate strength which is less than the ultimate strength of an undeformed portion of said bale tie but greater than the ultimate strength of said joint.

10. The package as set forth in claim 9, wherein:

said joint has an ultimate strength which is approximately 65% of said ultimate strength of said undeformed portion of said bale tie, and said ultimate strength of said bale tie bent to form said at least one marcelled portion is approximately 85–95% of said ultimate strength of said undeformed portion of said bale tie.

11. The package as set forth in claim 6, wherein:

a plurality of bale ties, each having said two marcelled means defined along said portions thereof, are wrapped about said bale at positions longitudinally spaced along said bale.

12. The package as set forth in claim 11, wherein:

said plurality of bale ties comprises eight bale ties wrapped about said bale.

13. The bale tie of claim 2, wherein:

said length of said marcelled portions comprises approximately one-fifth of said overall length of said tie element.

14. The package as set forth in claim 8, wherein:

said length of said marcelled portions comprises approximately one-fifth of said overall length of said bale tie.

* * * * *